US010001794B2

(12) United States Patent
Olejarz

(10) Patent No.: US 10,001,794 B2
(45) Date of Patent: Jun. 19, 2018

(54) SOFT START CIRCUIT AND METHOD FOR DC-DC VOLTAGE REGULATOR

(71) Applicant: Analog Devices, Inc., Norwood, MA (US)

(72) Inventor: Piotr Olejarz, Watertown, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days. days.

(21) Appl. No.: 14/563,453

(22) Filed: Dec. 8, 2014

(65) Prior Publication Data

US 2016/0091909 A1 Mar. 31, 2016

Related U.S. Application Data

(60) Provisional application No. 62/057,468, filed on Sep. 30, 2014.

(51) Int. Cl.

| | |
|---|---|
| ***G05F 1/56*** | (2006.01) |
| ***G05F 1/42*** | (2006.01) |
| ***G05F 1/10*** | (2006.01) |

(52) U.S. Cl.

CPC ..... *G05F 1/56* (2013.01); *G05F 1/10* (2013.01); *G05F 1/42* (2013.01)

(58) Field of Classification Search

CPC ..... G05F 1/00
USPC ..... 323/280, 288, 299
See application file for complete search history.

(56) References Cited

U.S. PATENT DOCUMENTS

| | | | | |
|---|---|---|---|---|
| 5,578,916 | A * | 11/1996 | Muterspaugh | G05F 1/573 323/267 |
| 6,724,257 | B2 | 4/2004 | Wrathall | |
| 7,199,565 | B1 * | 4/2007 | Demolli | G05F 1/575 323/273 |
| 7,518,348 | B1 | 4/2009 | Kobayashi | |
| 8,299,767 | B1 | 10/2012 | Tuozzolo et al. | |
| 2002/0030472 | A1 * | 3/2002 | Miki | G05F 1/575 323/282 |

(Continued)

OTHER PUBLICATIONS

Patoux, Jerome, "Low-Dropout Regulators", Analog Dialogue 41-05, May 2007 http://www.analog.com/analogdialogue, (May 1, 2007), 1-3.

*Primary Examiner* — Kyle J Moody
*Assistant Examiner* — Trinh Q Dang
(74) *Attorney, Agent, or Firm* — Schwegman Lundberg & Woessner, P.A.

(57) ABSTRACT

A voltage regulator is provided comprising: a pass transistor that includes a first node coupled to receive an input voltage and a second node coupled to provide a regulated voltage and a control node; an amplifier circuit coupled to produce a control voltage on a control line that is coupled to control a voltage at the control node of the pass transistor, based at least in part upon a reference voltage and the regulated voltage; a switch configured to transition between a first switch state in which the switch couples the control line to a turn-off voltage having a value to turn off the pass transistor and a second switch state in which the switch decouples the control line from the turn-off voltage; and a switch control circuit configured to maintain the switch in the first switch state during a first time interval while the input voltage ramps up and to transition the switch to the second switch state after the first time interval.

20 Claims, 3 Drawing Sheets

(56) References Cited

U.S. PATENT DOCUMENTS

| | | | | |
|---|---|---|---|---|
| 2005/0105307 | A1* | 5/2005 | Shearon | G06F 1/26 363/49 |
| 2009/0033311 | A1* | 2/2009 | Sperling | G05F 3/262 323/316 |
| 2009/0174385 | A1* | 7/2009 | Yen | H02M 1/36 323/288 |
| 2010/0284116 | A1* | 11/2010 | Yoshizawa | H02H 9/001 361/91.3 |
| 2011/0156688 | A1* | 6/2011 | Lin | H02M 1/32 323/284 |
| 2012/0013317 | A1* | 1/2012 | Morino | G05F 1/565 323/280 |
| 2012/0062198 | A1* | 3/2012 | Takano | H02M 1/36 323/282 |
| 2012/0153924 | A1* | 6/2012 | Lipka | G05F 1/56 323/299 |
| 2012/0169303 | A1* | 7/2012 | Chen | G05F 1/573 323/265 |
| 2013/0285631 | A1* | 10/2013 | Bisson | G05F 1/575 323/280 |
| 2013/0285635 | A1* | 10/2013 | Shimizu | H02M 3/156 323/288 |
| 2013/0307501 | A1* | 11/2013 | Kadanka | G05F 1/56 323/274 |
| 2014/0042994 | A1 | 2/2014 | Choi | |
| 2014/0217999 | A1* | 8/2014 | Wibben | H02M 1/36 323/282 |
| 2014/0266122 | A1 | 9/2014 | Zhu et al. | |
| 2014/0266397 | A1 | 9/2014 | Yuan et al. | |
| 2015/0002123 | A1* | 1/2015 | Makigawa | H02J 1/06 323/284 |
| 2015/0035505 | A1* | 2/2015 | Peluso | G05F 1/575 323/273 |

* cited by examiner

SOFT START CIRCUIT AND METHOD FOR DC-DC VOLTAGE REGULATOR

CLAIM OF PRIORITY

This patent application claims the benefit of priority to U.S. Patent Application Ser. No. 62/057,468, filed Sep. 30, 2014, which is hereby incorporated by reference herein in its entirety.

BACKGROUND

Voltage regulators are used to provide a stable power supply voltage independent of load impedance, input-voltage variations, temperature, and time, and process. Low-dropout (LDO) regulators are generally distinguished by their ability to maintain regulation with small differences between supply voltage and load voltage. The dropout voltage in an LDO is the difference between the output voltage and the input voltage at which the circuit quits regulation with further reductions in input voltage.

A typical voltage regulator includes a reference voltage, an error amplifier circuitry to compare the reference voltage to an output voltage and a series pass transistor (e.g., bipolar or FET), whose voltage drop is controlled by the amplifier to maintain an output voltage at the required value. A supply voltage is provided to a first terminal of the pass transistor and the load voltage produced by the voltage drop is provided at a second terminal of the pass transistor. If, for example, as a load current decreases, causing the output voltage to rise incrementally, an error voltage will increase, the amplifier output will rise, the voltage across the pass transistor will increase, and the output voltage will return to its original value.

When a supply voltage is initially turned on it may ramp up before an amplifier circuit has time to adjust to the initial ramp up.

SUMMARY

In one aspect, a voltage regulator includes a pass transistor that includes a first node coupled to receive an input voltage, a second node coupled to provide a regulated voltage and a control node. An amplifier circuit is coupled to produce a control voltage on a control line that is coupled to control a voltage at the pass transistor control node, based at least in part upon a reference voltage and the regulated voltage. A switch includes a transistor configured to transition between a first switch state in which the switch operatively couples the control line to a turn-off voltage having a value to turn off the pass transistor and a second switch state in which the switch decouples the control line from the turn-off voltage. A switch control circuit includes a signal delay circuit configured to maintain the switch in the first switch state during a first time interval while the input voltage ramps up and to transition the switch to the second switch state after the first time interval.

In another aspect, a method is provided for use in a voltage regulator circuit that includes, a pass transistor coupled to receive a supply voltage and to provide a regulated voltage, an amplifier circuit coupled to receive a reference voltage and an indication of the regulated voltage and to provide a control signal on a control line that is coupled to control turn on of the pass transistor. The method includes receiving a supply voltage ramp up at a supply node of a pass transistor. In response to receiving the supply voltage ramp up, a turn-off voltage that turns off the pass transistor is coupled to the control line for a time interval that is long enough for the control line to charge to at least a normal steady state value. The turn-off voltage is decoupled from the control line after the time interval.

DESCRIPTION OF EMBODIMENTS

Figure 1:
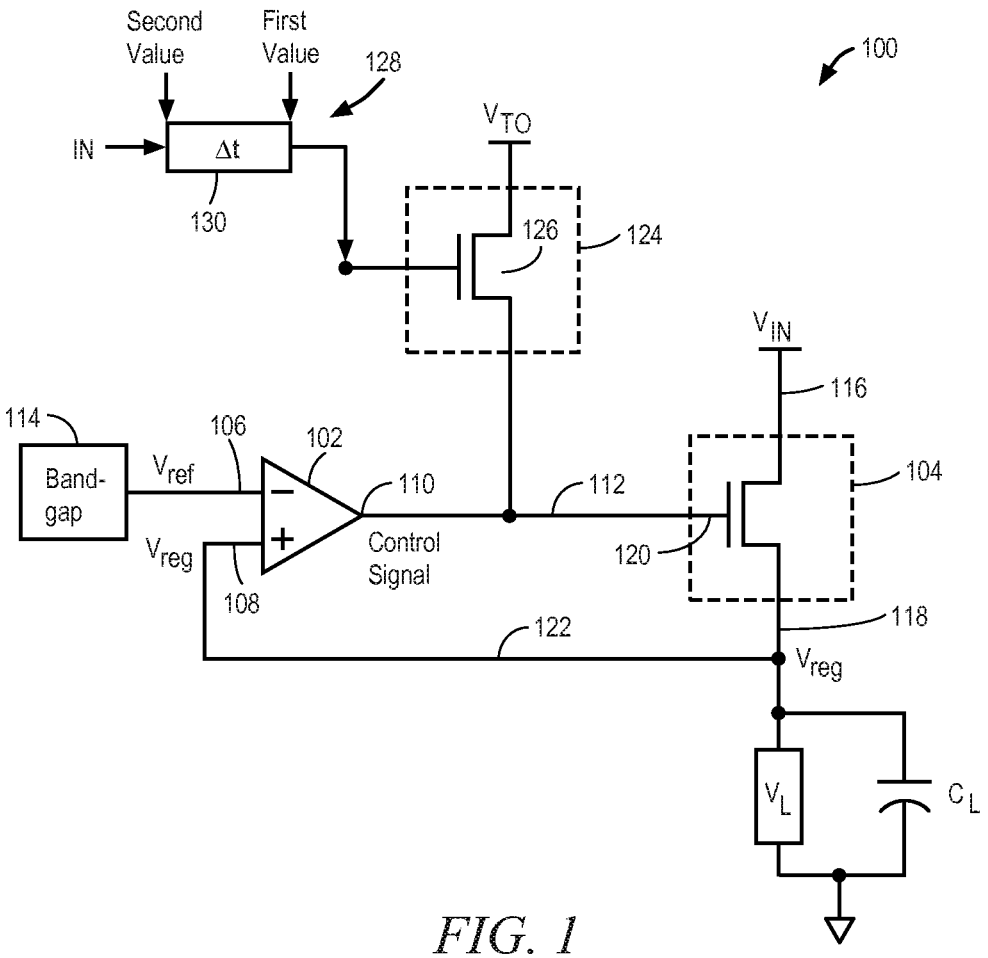
FIG. 1 is an illustrative simplified schematic diagram representing a voltage regulator in accordance with some embodiments.

The following description is presented to enable any person skilled in the art to create and use a DC-DC voltage regulator with soft startup. Various modifications to the embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. In other instances, circuit structures and processes are shown in block diagram form in order not to obscure the description of the invention with unnecessary detail. Identical reference numerals may be used to represent different views of the same item in different drawings. Thus, the present invention is not intended to be limited to the embodiments shown, but is to be accorded the widest scope consistent with the principles and features disclosed herein.

FIG. 1 is an illustrative simplified schematic diagram representing a voltage regulator 100 in accordance with some embodiments. In general, the voltage regulator 100 acts as a DC to DC voltage converter that converts a higher level external supply voltage $V_{in}$ to a lower level internal regulated voltage $V_{reg}$ that is used to power a load circuit $V_L$. The actual value of the regulated voltage $V_{reg}$ is monitored and comparted with a reference voltage $V_{ref}$. The value of the regulated voltage is adjusted based upon a difference between the regulated voltage $V_{reg}$ and the reference voltage $V_{ref}$.

More particularly, the voltage regulator 100 includes an operational amplifier circuit 102 and a pass transistor circuitry 104. A first input terminal 106 of the amplifier 102 is coupled to receive a first input signal that provides an indication of the reference voltage, $V_{ref}$. A second input terminal 108 of the operational amplifier 102 is coupled to receive a second input signal that provides an indication of the internal regulated voltage, $V_{reg}$. An output terminal 110 of the amplifier 102 provides a control signal that is operatively coupled to a control line 112 and that is used to control current flow through the pass transistor 104, which in turn, determines a magnitude of the regulated voltage $V_{reg}$ indicated on the second input terminal 108 of the amplifier 102. In some embodiments, the first signal indicating $V_{ref}$ is coupled to a negative terminal of the amplifier, and the second input signal indicating $V_{reg}$ is coupled to the positive terminal of the amplifier. In accordance with some embodiments bandgap voltage reference 114 produces a $V_{ref}$ value that is substantially fixed irrespective of power supply variations, temperature changes and the loading on the regulator 100. The voltage regulator 100 acts as a LDO voltage regulator since it regulates the voltage $V_{in}$ down from 3.3V (a higher DC voltage supply) to 1.2V (a lower DC voltage). Here the drop out voltage is 2.1V across the PNP device 202.

The pass transistor 104 is coupled to receive an external input voltage $V_{in}$ at a higher first voltage level and to provide the regulated voltage $V_{reg}$ at a lower second voltage level. The pass transistor 104 includes a first node 116 coupled to receive the input voltage $V_{in}$ and a second node 118 coupled to provide the regulated voltage $V_{reg}$. The pass transistor 104 includes a control node 120 coupled to control turn on and turn off of the pass transistor in response to the control signal. It will be appreciated that second input signal provided to the second input terminal 108 of the amplifier 102 provides an indication of $V_{reg}$ feedback from the pass transistor 102 output terminal. The regulator 100 is coupled to provide Vreg as the voltage power supply to a load $V_L$ having load capacitance $C_L$.

In some embodiments, the amplifier 102 acts as an error amplifier that compares the first input signal $V_{ref}$ with the second input signal $V_{reg}$ and produces the control signal that controls the pass transistor circuitry 104 so as to reduce the difference between the first and second input signals. The second input signal that is indicative of the current value of $V_{reg}$ is operatively coupled via feedback line 122 to the second terminal 108 of the amplifier 102. In response to the fed back second input feedback signal having a value indicating that $V_{reg}$ is higher than $V_{ref}$, the amplifier 102 provides a control signal value via line 122 that decreases current through the pass transistor circuitry 104, decreasing the output voltage $V_{reg}$. In response to the fed back second input signal having a value indicating that $V_{reg}$ is lower than $V_{ref}$, the amplifier 102 provides a control signal value via line 122 that increases current through the pass transistor circuitry 104, increasing the output voltage $V_{reg}$.

A switch circuit 124 that includes a transistor 126 that is controllable to switch between a first switch state 129 in which the switch couples to the control line 112 a turn-off voltage $V_{TO}$ having a value to turn off the pass transistor circuitry 104 and a second switch state 131 in which the switch 124 decouples the control line 112 from $V_{TO}$. A switch control circuit 128 that includes a signal delay circuit 130 configured to provide a switch control signal having a first value to maintain the switch 124 in the first switch state 129 during a first time interval and to provide the switch control signal having a second value to transition the switch 124 to the second switch state 131 after the first time interval. In accordance with some embodiments, $V_{TO}=V_{in}$, and in the first switch state 129, the switch circuit 124 couples the control line 112 to the input voltage level $V_{in}$, and in the second switch state 131, the switch circuit 124 decouples control line 112 from $V_{in}$.

The switch control circuit 128 provides a first switch control signal value at a rise in $V_{in}$ starting time, time $t_0$, that causes the switch circuit 124 to couple $V_{TO}$ to the control line 112 at the moment when the external supply voltage $V_{in}$ begins to rise to its normal operating steady state value. After a first delay interval, the switch control circuit 128 provides a second switch control signal value that causes the switch circuit 124 to decouple $V_{TO}$ from the control line 112. The delay circuit 130 imparts a delay between provision of the first switch control signal value and the second switch control signal value that is long enough so that the line 112 is charged to a voltage level (i.e. $V_{TO}$) sufficient to prevent the pass transistor circuitry 104 from turning on while the voltage $V_{in}$ rises. Moreover, the delay is long enough to accommodate estimated variations in PVT (process, voltage, temperature) that could influence the amount of time required for the voltage $V_{in}$ to rise from a voltage level in a turned off state and settle at a voltage level used during normal steady state operation. After the first time interval, with the control line 112 charged to voltage $V_{TO}$, the amplifier 102 takes on regulation of the operation of the pass transistor circuitry 104. Thus, prior to the amplifier's beginning to actively regulate $V_{reg}$, the line 112 is coupled to $V_{TO}$, which keeps the pass transistor turned off while $V_{in}$ rises, thereby protecting against $V_{reg}$ voltage overshoot that could damage the load circuitry $V_L$ and also facilitating a smooth transition to voltage regulation by the amplifier 102, for example.

Figure 2:
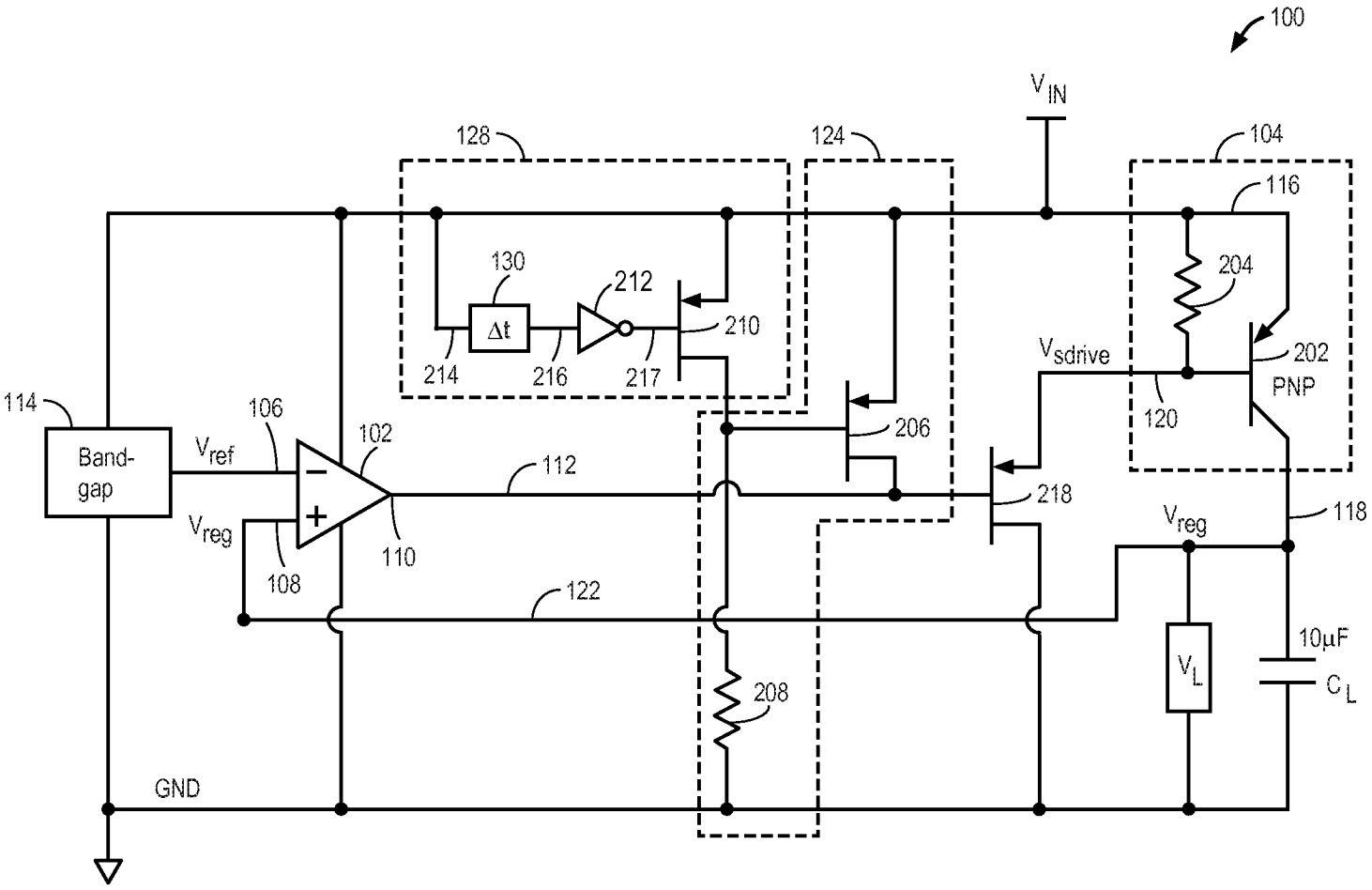
FIG. 2 is an illustrative circuit level diagram showing additional details of the voltage regulator of FIG. 1 in accordance with some embodiments.

FIG. 2 is an illustrative circuit level diagram showing additional details of the voltage regulator 100 of FIG. 1 in accordance with some embodiments. The pass transistor circuitry 104 shown within dashed lines includes a bipolar PNP pass transistor 202 having a first resistor 204 coupled across its base-emitter junction. The emitter is coupled to the external voltage $V_{in}$. The resistor 204 has a first terminal coupled to $V_{in}$, which also is coupled to the PNP's emitter, and has a second terminal coupled to the PNP's base. The switch circuit 124 shown within dashed lines includes a first PMOS transistor 206 (also referred to herein as "first transistor 206") and second resistor 208 coupled between a gate of the first PMOS transistor 206 and ground potential. The first transistor 206 has a source coupled to $V_{in}$ and has a drain coupled to the control line 112. The switch control circuit 128 includes the delay circuit 130 and a second PMOS transistor 210 (also referred to herein as "second transistor 210") and an inverter 212 coupled between them. The delay circuit has an input line 214 coupled to $V_{in}$ and an output line 216 coupled to an input of the buffer circuit 212. An output of the buffer circuit 212 is coupled to a gate 217 of the second transistor 210. The second transistor 210 includes a source coupled to $V_{in}$ and includes a drain coupled to the gate of the first transistor 206. The second resistor 208 is coupled between the drain of the second transistor 210 and ground potential. A third PMOS transistor 218 (also referred to herein as "third transistor 218") includes a source coupled to the second terminal of the resistor 204, which also is coupled to the NPN's base, a drain coupled to ground potential and a gate coupled to the control line 112. The amplifier 102 and bandgap voltage reference source 114 are coupled and biased as shown and as described above with reference to FIG. 1.

Figure 3:
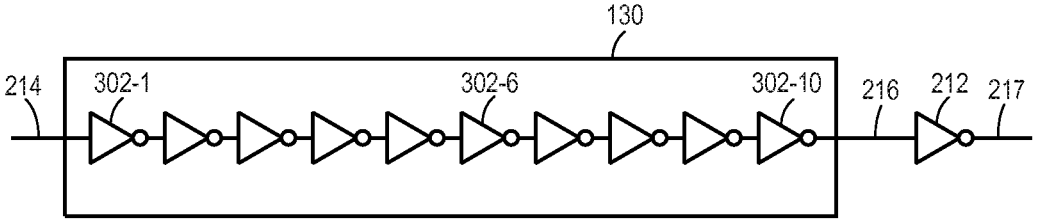
FIG. 3 is an illustrative schematic diagram that shows additional details of the delay circuit and buffer circuit of FIG. 2 in accordance with some embodiments.

FIG. 3 is an illustrative schematic diagram that shows additional details of the delay circuit and buffer circuit 212 of FIG. 2 in accordance with some embodiments. The delay circuit 130 includes a plurality of delay elements 302-1 to 302-10, each of which imparts incremental delay to a signal received by it. The delay circuit receives an input signal on line 214 and provides an output signal on line 216. In accordance with some embodiments, each delay element includes an inverter circuit, and each inverter circuit imparts the same delay increment to a signal propagated through it. More particularly, each inverter circuit inverts the logical value of a signal received at its input. The illustrative delay circuit 130 includes an even number of inverter circuits, i.e. ten, and consequently, the logical value of a signal provided at the input 214 results in provision of a signal having the same logical value at the output 216 after passing through each of the delay elements 302-1 to 302-10. Thus, the amount of delay imparted by the delay circuit 130 is proportional to the amount of delay imparted by each delay element and the number of delay elements.

In accordance with some embodiments, the buffer circuit 212 also includes an inverter circuit. As explained above, a signal input to the delay circuit 130 at input line 214 has the same logical value when it is output at output line 216 after propagating through the multiple delay elements 302-1 to 302-10. The buffer/inverter 212 provides to the gate 217 of the second transistor 210, after delay imparted by each of the delay elements 302-1 to 302-10 and by the buffer inverter 212 itself, a signal that has a logical value that is the inverse of the logical value of a signal received at the input 214 of the delay circuit 130.

During normal steady state operation, an example embodiment of the voltage regulator 100 has an external voltage $V_{in}$ of 3.3V, a reference voltage $V_{ref}$ of 1.2V and a regulated voltage $V_{reg}$ of approximately 1.2V. The first resistor 204 has a value of 1K ohms. During normal steady state operation, the first transistor 206 is turned off, and $V_{in}$ is decoupled from the control line 112. The third transistor 218 acts as an interface circuit operatively coupled between the amplifier 102 and the pass transistor circuitry 104 to control voltage drop across the pass transistor circuit in response to voltage on the control line 112. More specifically, the third transistor 218 acts as a current control circuit that controls operation of the PNP transistor 202 in response to voltage value on the control line 112. In the example embodiment, during normal operation, the first node 116 of the PNP transistor 202 receives external voltage $V_{in}$=3.3V, and the control line 112 has a voltage of approximately 1.5V, resulting in the third transistor 218 having $V_{GS}$<0. Consequently, the third transistor 218 turns on. Current flows from $V_{in}$ at the first node 116 through the first resistor 204 and the third transistor 218 to ground, resulting in $V_{BE}$ of the PNP transistor 202 rising above 0.6V, which in turn, results in turn-on of the PNP transistor 202. The current flow through the PNP transistor 202 produces voltage at the second node 118 of approximately 1.2V.

It will be appreciated that the reason node 118 is at 1.2V is that the PNP collector voltage, at node 118, is set by the feedback loop, and in the example embodiment, the feedback imposes the collector to be the same as the 1.2 V bandgap reference voltage per the error amplifier 102 wanting its positive/negative terminals to be the same. In other words, since the bandgap reference voltage is set to 1.2V, there is a 2.1V drop across the PNP device 202. Thus, it will be understood that if, for example, the bandgap reference voltage was to be set at 1.3V, then the drop across the PNP device 202 would be 2.0V. Moreover, if for example, the supply voltage at node 116 was to be set at 3.0V, then the drop across the PNP device 202 would be 1.8V. The voltage drop across the PNP device is set by the difference between the $V_{in}$ supply and the desired $V_{reg}$ value and in this example embodiment the VBE of the PNP is set by the feedback loop so node 118 tracks the bandgap reference voltage value because the error amplifier 102 wants its positive and negative terminals to be equal. Thus, the voltage on the control line 112 controls voltage of the base terminal of the PNP device 202, which is its, which sets it $V_{BE}$.

During normal operation, the load circuit $V_L$ which may be a microprocessor core (not shown), for example, may from time to time draw more or less current resulting in variation in the internal regulated voltage $V_{reg}$. The load capacitance $C_L$ helps with the stability of the control loop of the design and acts as a decoupling capacitance to minimize any overshoots and undershoots when the load current changes abruptly. The amplifier 102 continually monitors value of $V_{reg}$ via feedback line 122 and compares an indication of the value of $V_{reg}$ with $V_{ref}$. Based upon results of the comparison, the amplifier 102 provides a control signal via control line 112 that adjusts the gate voltage of the third transistor 218 so as to regulate current flow through PNP transistor 202 to thereby regulate $V_{reg}$ to keep it at about 1.2V. In accordance with some embodiments, the control signal amplifies a difference between an indication of the value of $V_{reg}$ and $V_{ref}$. More particularly, adjustments to the gate voltage of the third transistor 218 result in corresponding changes in current flow through it. Changes in current flow through the third transistor 218 result in changes in current flow through the first resistor 204. Change in current flow through the first resistor 204 results in change in an IR voltage drop across the first resistor, which results in change in $V_{BE}$ of the PNP transistor 202 and corresponding change in current flow through the PNP transistor 202. Change in current flow through the PNP transistor 202 results in change in the value of $V_{reg}$ at the output node 118. Thus, in the example embodiment, during normal steady state operation, a feedback loop involving the amplifier 102 and the pass transistor circuitry 104 maintains $V_{reg}$ at approximately a fixed value of 1.2V. It will be appreciated that $V_{reg}$ may vary somewhat during steady state operation and that it is the role of the amplifier feedback circuit to keep $V_{reg}$ as fixed at about 1.2V.

During a startup time interval when $V_{in}$ is initially applied, there is a risk of voltage overshoot at node 118 that could result in damage to the load circuit $V_L$. For example, during a time frame before the feedback control circuitry that includes the amplifier 102 has settled, a voltage applied to load circuit $V_L$ may temporarily exceed the limit set for $V_{reg}$. Continuing with the above example, the voltage at node 118 may rise temporarily to 1.5V, for example, before the amplifier 102 is able to regulate it and bring it back down to the 1.2V level. The voltage overshoot may result in damage or degradation to the internal circuitry of the load circuit $V_L$, which may be a microprocessor for example, which over the course of many $V_{in}$ turn-on cycles may result in load circuit failure. The switch circuit 124 and the switch control circuit 128 achieve a soft start of the voltage regulator 100 that avoids voltage overshoot of the regulated voltage $V_{reg}$ that otherwise could occur in the course of initial application of the external voltage $V_{in}$ during startup of the circuit 128 (and startup of entire circuitry 100). Continuing with the explanation of the example embodiment, initially during startup, the external voltage $V_{in}$ is applied and ramps up to 3.3V. In accordance with some embodiments, $V_{in}$ ramps up from 0 Volts to 3.3 volts in one microsecond. The external voltage $V_{in}$ is provided as an input signal to the input terminal 214 of the delay circuit 130 and after a delay time interval determined by the delay imparted by the delay elements 302-1 to 302-10 through which it propagates, the value $V_{in}$ is provided at the output terminal 216 of the delay circuit 130.

Initially during startup, a 0V input signal is provided to the inverter 212, which results in the inverter following the rise of $V_{in}$ and providing a 3.3V output to the gate of the second transistor 210 after the one microsecond rise time. Thus, initially, during the delay time interval before the $V_{in}$ voltage propagates though the delay circuit 130, the second transistor 210 is turned off. Conversely, during the delay time interval before the $V_{in}$ voltage propagates though the delay circuit 130, the first transistor 206 is turned on. The gate of the first transistor initially is at 0V and remains at 0V, tied to ground potential by the second resistor 208 while the first transistor 210 remains turned off. Thus, during the delay time interval before the $V_{in}$ voltage propagates though the delay circuit 130, the first transistor 206 couples the control line 112 to $V_{in}$.

Initially during startup, a source voltage of the third transistor 218, referred to herein as $V_{Sdrive}$, is tied by the first resistor 204 to the value of $V_{in}$, and consequently rises to 3.3V since the third transistor 218 remains turned off. More specifically, since the gate of the third transistor 218 is coupled to the control line 112, which is coupled by the first transistor 206 to $V_{in}$. The $V_{GS}$ voltage of the third transistor 218 is below its threshold Voltage $V_{th}$ and is therefore turned off. The strength of the first transistor 206 determines how close it pulls the control line 112 to the supply voltage level $V_{in}$. A large, strong device 206 may pull the control line 112 and gate of the third transistor 218 as high as $V_{in}$. However, in the example embodiment, a weaker and smaller device 206 was used just to ensure that over PVT the gate of the first transistor 206 would be high enough to make sure that the third transistor 218 remains turned off, by ensuring that over PVT initially the voltage on the control line 112 is high enough so the Vgs of 218 is below its $V_{th}$. Thus, initially, before the $V_{in}$ voltage propagates though the delay circuit 130, third transistor 218 remains turned off. No current flows through the first resistor 204. Consequently, voltage $V_{BE}$ is 0V, and the PNP transistor 202 remains turned off. Therefore, during the delay time interval between the initial rise of $V_{in}$ and the propagation of the $V_{in}$ value through the delay circuit 130, the regulated voltage $V_{reg}$ does not rise and remains at about 0V because it has no currents supplied from the PNP device.

After the delay time interval, upon arrival of the $V_{in}$ value at the input of inverter 212, the inverter 212 provides a 0V signal to the gate of the second transistor 210, which turns on that device. The second resistor 208 has a relatively large value so that even a relatively small current through the second transistor 210 results in a voltage at the gate of the first transistor 206 sufficient to turn it off. In the example embodiment, the second resistor has a value of 1 Mega Ohm. Thus the second transistor 210 can easily pull the gate of the first transistor 206 high therefore turning it off.

The first transistor turns off as its $V_{GS}$ goes to 0V. The turn off of the first transistor 206 decouples the control line from voltage $V_{in}$. It will be appreciated that at the moment that the control line 112 is decoupled from Vin, it already has been precharged to about a value close to $V_{TO}$. It will be appreciated that the precharge value on the control line 112 should be higher than $V_{TO}-V_{th}$ of the third transistor 218 over PVT. This will ensure that the third transistor 218 has its $V_{GS}<V_{th}$, and therefore, will be turned off. Assuming that the $V_{th}$ is 0.6V, then as long as the gate of the third transistor 218 is higher than 3.3−0.6=2.7V, then the third transistor 218 will remain turned off. The device size of the first transistor 206 will dictate how high the precharge voltage on control line 112 can be, and it can also vary over PVT as long as the third transistor 218 remains off. Following its decoupling, the voltage on the control line 112 drops resulting in a lower voltage applied to the gate of the third transistor 218, allowing the third transistor 218 to turn on. Current flows through the first resistor 204 causing voltage across $V_{BE}$ to reach a diode drop turn-on 0.6 V threshold, resulting in current flow through the PNP transistor 202 and a corresponding rise in $V_{reg}$.

As the PNP transistor 202 is enabled, voltage at node 118 rises and eventually reaches its final value of 1.2V. The amplifier 102 begins to regulate $V_{reg}$ and maintain it at the desired level. Once the amplifier 102 has settled into normal operation, the $V_{Sdrive}$ voltage at the source of the third transistor 218 and a voltage on the control line 112 settle into their normal steady state operating levels.

Figure 4:
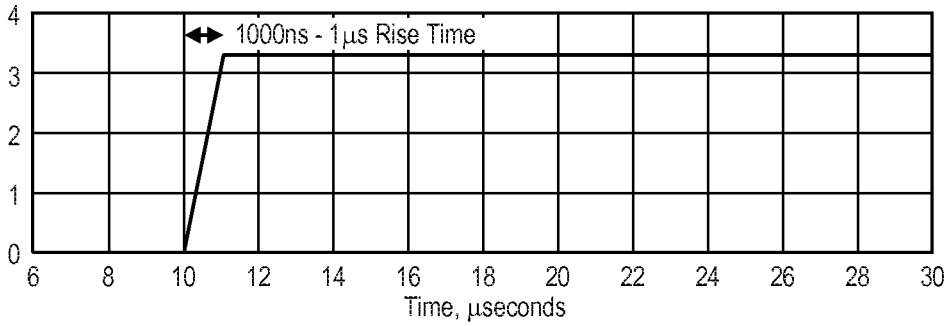
FIG. 4 is an illustrative timing diagram showing a voltage curve representing simulation results of a ramp up of an external input voltage during startup in accordance with some embodiments.

FIG. 4 is an illustrative timing diagram showing a voltage curve representing simulation results of a ramp up of an external input voltage $V_{in}$ during startup in accordance with some embodiments. The external input voltage $V_{in}$ has a fast rise time. In the above example embodiment, $V_{in}$ rises from 0V to 3.3V in approximately 1000 nanoseconds (one microsecond)

Figure 5:
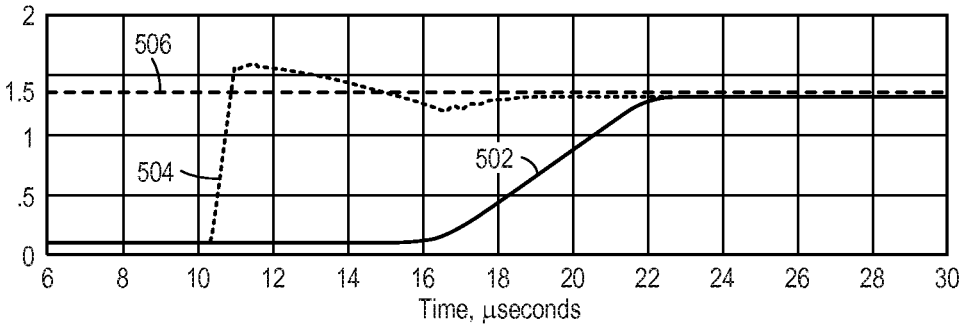
FIG. 5 is an illustrative timing diagram showing voltage curves representing simulation results of ramp up of a regulated voltage with and without soft startup and also showing a maximum safe voltage level in accordance with some embodiments.

FIG. 5 is an illustrative timing diagram showing voltage curves representing simulation results of ramp up of a regulated voltage $V_{reg}$ with and without soft startup and also showing a maximum safe $V_{reg}$ voltage level in accordance with some embodiments. The curve 502 shows $V_{reg}$ simulation results with soft startup circuitry. The curve 504 shows $V_{reg}$ simulation results without soft startup circuitry. The curve 506 shows a maximum safe $V_{reg}$ level for the simulated circuit. The curve 506 indicates that the maximum permitted $V_{reg}$ is 1.35V in the above example embodiment. From the curve 504, it can be seen that without the soft startup circuitry, $V_{reg}$ rises nearly as fast as $V_{in}$ to a voltage greater than the safe maximum and remains above the safe maximum for approximately two microseconds before falling back below the safe level as the amplifier 102 settles and begins to regulate $V_{reg}$. From the curve 502, it can be seen that with the soft startup circuitry, the beginning of the rise of $V_{reg}$ is delayed by almost three microseconds, the rise in $V_{reg}$ is more gradual, and that $V_{reg}$ never rises above the safe voltage level.

Figure 6:
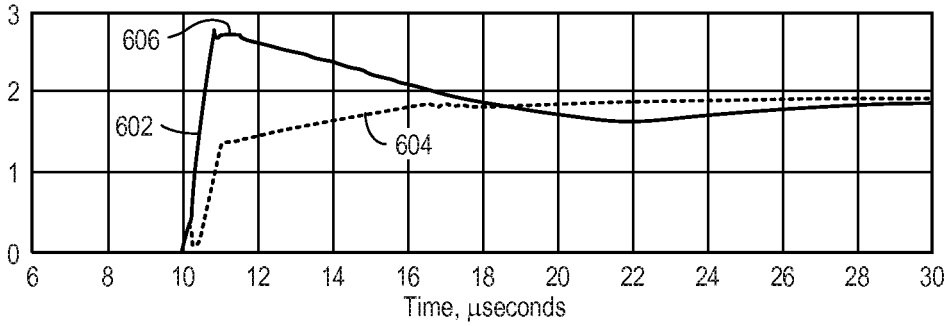
FIG. 6 is an illustrative timing diagram showing voltage curves representing simulation results of voltage on an amplifier output control line during ramp up of an external input voltage with and without soft startup in accordance with some embodiments.

FIG. 6 is an illustrative timing diagram showing voltage curves representing simulation results of voltage on the amplifier output control line 112 during ramp up of an external input voltage $V_{in}$ with and without soft startup in accordance with some embodiments. The curve 602 shows voltage on the control line 112 with soft startup circuitry. The curve 604 shows voltage on the control line 112 without soft startup circuitry. From the curve 602, it can be seen that with the soft startup circuitry, voltage on the control line 112 rises nearly as fast as $V_{in}$ to approximately 2.8V, It will be understood from the explanation above that the voltage at the control line 112 can approach the supply voltage $V_{in}$=3.3V, but must be high enough over PVT variations to make sure that the $V_{GS}$ of transistor 218 remains below its $V_{th}$, immediately following turn on of the supply voltage $V_{in}$. After about five milliseconds the voltage on the control line 112 drops to about 1.6V, which is within the normal range 607 of control signal voltage provided by the amplifier 102 during steady state operation. More particularly, before a time of occurrence of a flattened portion of the curve at about point 606, the second transistor 210 is turned off and the first transistor 206 is in a turned on state, coupling the control line 112 to the supply voltage $V_{in}$. As explained more fully below, in some embodiments, the first transistor 206 is not strong enough to actually pull the control line 112 all of the way to the supply voltage value, but it is strong enough to pull the voltage of the control line to a turn off voltage value $V_{TO}$, sufficient to keep the pass transistor 202 turned off. At a time of occurrence of the flattened portion of the curve at about point 606, the second transistor 210 turns on, and in response, the first transistor 206 transitions to an off state in which the control line is decoupled from the supply voltage $V_{in}$, and after that point the voltage on the control line 112 gradually falls to its steady state value.

Thus, the first transistor 206 is turned on, coupling the control line 112 to a turn-off voltage($V_{TO}$) which may approach $V_{in}$, during a time interval from approximately the start of the rise of $V_{in}$ until time corresponding when the voltage on the control line 112 has risen to a precharge value that equals or exceeds its steady state value range 607. In the example embodiment, the time interval extends from approximately the start of the rise of $V_{in}$ until approximately a time corresponding to point 606, and is long enough for the voltage on the control line 112 to reach a voltage value that exceeds its steady state value range 607. In the example embodiment, after the first transistor 206 turns off, the feedback loop can be closed and the voltage on the control line 206 is being driven by the error amplifier 102, and it smoothly decreases to its steady state value range 607, where the amplifier 102 controls its value to control the smooth turn on of the third transistor 218. This in turn will smoothly turn on the PNP device. From the curves 504 and 604, it can be seen that at start up without the soft startup circuitry, the regulated voltage $V_{reg}$ rises higher than the 1.35V safe level indicated by curve 506, before voltage on the control line 112 rises to its steady state operating voltage level at which the amplifier 102 provides feedback control.

Figure 7:
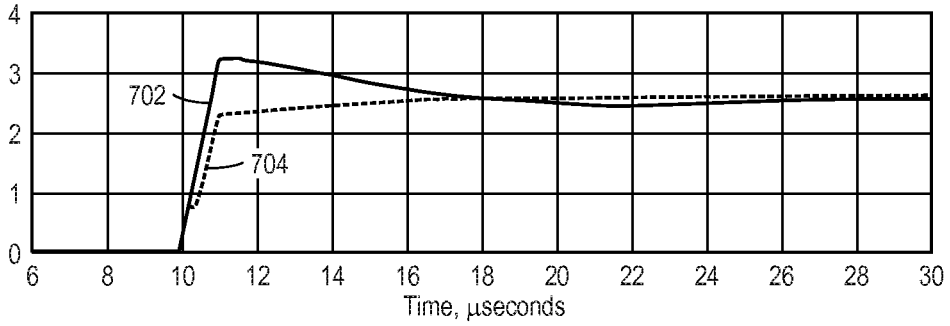
FIG. 7 is an illustrative timing diagram showing voltage curves representing simulation results of voltage on the source terminal of a PMOS transistor that acts as a current source interface to a pass transistor with and without soft startup in accordance with some embodiments.

FIG. 7 is an illustrative timing diagram showing voltage curves representing simulation results of voltage $V_{Sdrive}$ on the source terminal of the third transistor 218 with and without soft startup in accordance with some embodiments. The curve 702 shows $V_{Sdrive}$ voltage of the third transistor 218 with soft startup circuitry. The curve 704 shows $V_{Sdrive}$ voltage of the third transistor 218 without soft startup circuitry. From the curve 702, it can be seen that with the soft startup circuitry, the $V_{Sdrive}$ voltage rises nearly as fast as $V_{in}$ to approximately 3.3V. Together with the fast rising voltage on the control line 112 shown by curve 602 in FIG. 6, $V_{GS}$=0V for the third PMOS transistor 218, which remains turned off because the control line 112 is at 2.8V, the $V_{GS}$ of the third transistor 218 is 0.5V, which is below its $V_{th}$ and therefore the third transistor 218 is turned off, so the first resistor 204 pulls $V_{Sdrive}$ to 3.3V. After about three microseconds, the source voltage of the third transistor 218 falls to its normal steady state range as the voltage on the control line 112 falls to its normal steady state range and the PNP transistor 202 turns on.

The foregoing description and drawings of embodiments are merely illustrative of the principles of the invention. For example, alternatively, the pass transistor can be implemented using an using a P-Type field effect (PFET) transistor. For a PFET alternative, a PFET is substituted for the PNP 202. Specifically, in accordance with some embodiments, the PFET source is coupled to $V_{in}$, the drain is coupled to $V_{reg}$ and the gate is coupled to the control line 112. Moreover, the regulated voltage may be scaled using a resistor divider network and the scaled version of the regulated voltage may be provided to the amplifier, for example. Various modifications can be made to the embodiments by those skilled in the art without departing from the spirit and scope of the invention, which is defined in the appended claims.

The invention claimed is:

1. A voltage regulator control circuit configured to couple to and control a PNP pass transistor of a voltage regulator, the pass transistor including a first node to receive an input voltage, a second node to provide a regulated voltage, and a control node, wherein the first node include an emitter, the second node includes a collector, and the control node includes a base, the control circuit comprising:

a resistor having a first terminal coupled to the emitter and having a second terminal coupled to the base; and a field effect transistor having a source coupled to the second terminal of the resistor, having a drain coupled to ground and having a gate operatively coupled to the control line an amplifier circuit coupled to produce a control voltage on a control line that is coupled to control a voltage at the control node of the pass transistor, based at least in part upon a reference voltage and the regulated voltage;

a switch that includes a transistor configured to transition between a first switch state in which the switch operatively couples the control line to a turn-off voltage having a value to turn off the pass transistor and a second switch state in which the switch decouples the control line from the turn-off voltage; and a switch control circuit that includes a signal delay circuit configured to maintain the switch in the first switch state during a first time interval while the input voltage ramps up and to transition the switch to the second switch state after the first time interval.

2. A voltage regulator control circuit configured to couple to and control a PNP pass transistor of a voltage regulator, the pass transistor including a first node to receive an input voltage, a second node to provide a regulated voltage, and a control node, wherein the first node include an emitter, the second node includes a collector, and the control node includes a base, the control circuit comprising:

an amplifier circuit coupled to produce a control voltage on a control line that is coupled to control a voltage at the control node of the pass transistor, based at least in part upon a reference voltage and the regulated voltage;

a switch that includes a transistor configured to transition between a first switch state in which the switch operatively couples the control line to a turn-off voltage having a value to turn off the pass transistor and a second switch state in which the switch decouples the control line from the turn-off voltage; and a switch control circuit that includes a signal delay circuit configured to maintain the switch in the first switch state during a first time interval while the input voltage ramps up and to transition the switch to the second switch state after the first time interval;

wherein the switch control circuit includes a field effect transistor and a delay circuit;

wherein a source of the field effect transistor is coupled to receive the input voltage and a drain of the field effect transistor is coupled to provide a switch control signal to a control terminal of the switch transistor; and wherein an input of the delay circuit is coupled to receive the input voltage and an output of the delay circuit is operatively coupled to the gate of field effect transistor.

3. A voltage regulator control circuit configured to couple to and control a pass transistor of a voltage regulator, the pass transistor including a first terminal to receive an input voltage, a second terminal to provide a regulated voltage, and a control terminal, the control circuit comprising:

an amplifier circuit coupled to produce a control voltage on a control line that is coupled to the control terminal of the pass transistor;

a switch that includes a first transistor configured to transition, between a first switch state in which the first transistor operatively couples the control line to a turn-off voltage having a value to turn off the pass transistor and a second switch state in which the first transistor decouples the control line from the turn-off voltage;

a switch control circuit that includes a second transistor and a delay circuit, wherein the second transistor turns on in response to a ramp up of the input voltage and wherein the delay circuit is configured to delay providing a turn-off signal to the second transistor until the input voltage ramps up to at least its steady state, wherein the second transistor is configured to turn off the first transistor while the second transistor is turned on and to turn on the first transistor in response to the second transistor turning off.

4. The voltage regulator control circuit of claim 3, further comprising:

wherein the amplifier circuit is coupled in a feedback loop between the second terminal and the control terminal to produce the control voltage on the control line that is coupled to control a voltage at the control terminal of the pass transistor, wherein the control voltage is within a steady state control voltage range while the input voltage is at a normal steady state operation level, based at least in part upon a reference voltage and the regulated voltage;

an interface circuit that includes a current control circuit to block current flow within the pass transistor circuitry during the first time interval, in response to the turn-off voltage on the control line, and to regulate current flow within the pass transistor circuitry after the first time interval, based upon the control voltage on the control line.

5. The voltage regulator control circuit of claim 3 further comprising:

a resistor having a first terminal configured to be coupled to the first terminal of the pass transistor and having a second terminal configured to be coupled to the third terminal of the pass transistor; and a third field effect transistor having a drain coupled to the second terminal of the resistor, having a source coupled to ground and having a gate operatively coupled to the control line.

6. The voltage regulator control circuit of claim 4, wherein the signal delay circuit defines the first time interval to span a time during which the voltage on the control line rises above a steady state value range.

7. The voltage regulator control circuit of claim 4, wherein the signal delay circuit defines the first time interval to span a time during which the voltage on the control line rises above a steady state value range; and wherein the amplifier is configured to regulate the control voltage on the control line to the steady state range value after the first time interval.

8. The voltage regulator control circuit of claim 4, wherein the switch is responsive to a switch control signal; and wherein the switch control circuit is configured to provide the switch control signal having a first value to maintain the switch in the first switch state during a first time interval and to provide the switch control signal having a second value to transition the switch to the second switch state after the first time interval.

9. The voltage regulator control circuit of claim 4, wherein the switch is responsive to a switch control signal;

wherein the switch control circuit is configured to provide the switch control signal having a first value to maintain the switch in the first switch state during a first time interval and to provide the switch control signal having a second value to transition the switch to the second switch state after the first time interval; and wherein the amplifier circuit is configured to regulate the control voltage on the control line to the steady state value range after the first time interval.

10. The voltage regulator control circuit of claim 4, wherein the switch control circuit is configured to provide the switch control signal having the first value during input voltage rise to its steady state value; and wherein the switch control circuit is configured to continue to provide the switch control signal having the second value after the first time interval, while the input voltage is at its steady state value.

11. The voltage regulator control circuit of claim 4, wherein the interface circuit includes a third switch circuit that includes a transistor that is configured to control voltage drop across the pass transistor circuitry based at least in part upon voltage on the control line.

12. The voltage regulator control circuit of claim 4, wherein the pass transistor circuitry includes an PNP transistor, wherein the first terminal includes an emitter terminal, the second terminal includes a collector terminal and the control terminal includes a base terminal.

13. The voltage regulator control circuit of claim 4, wherein the amplifier circuit is configured to provide a control voltage on the control line that is indicative of a difference between the reference voltage and the regulated voltage.

14. The voltage regulator control circuit of claim 4 further including:

a band gap circuit coupled to provide the reference voltage to the amplifier circuit.

15. The voltage regulator control circuit of claim 4, wherein the switch includes a field effect transistor and a resistor, wherein the field effect transistor includes a source coupled to receive the input voltage, includes a drain coupled to a first terminal of the resistor and a gate coupled to the switch control circuit, and wherein a second terminal of the resistor is coupled to ground.

16. The voltage regulator control circuit of claim 4, wherein the pass transistor includes PFET transistor, wherein the first node includes a source terminal, the second node includes a drain terminal and the control node includes a gate terminal.

17. The voltage regulator control circuit of claim 4, wherein the first switch state further opens the feedback loop and the second switch state further closes the feedback loop.

18. In a voltage regulator control circuit configured to couple to and control a pass transistor of a voltage regulator, the voltage regulator to receive a supply voltage and to provide a regulated voltage, the voltage regulator including an amplifier circuit to receive a reference voltage and an indication of the regulated voltage and to provide a control signal on a control line that is coupled to control turn on of the pass transistor, a method comprising:

receiving a supply voltage ramp up at a supply node of the pass transistor;

in response to receiving the supply voltage ramp up, coupling the control line to a turn-off voltage; and blocking current flow in the pass transistor during the supply voltage ramp up, to turn off the pass transistor for a time interval that is long enough for the control line to charge to at least a normal steady state value range;

decoupling the turn-off voltage from the control line after the time interval; and regulating current flow within the pass transistor based upon a voltage of the control line after the supply voltage ramp up.

19. The method of claim 18 further comprising:

using the amplifier circuit to regulate a voltage on the control line after the time interval.

20. A voltage regulator control circuit configured to couple to and control a pass transistor of a voltage regulator, the pass transistor including a first terminal to receive an input voltage, a second terminal to provide a regulated voltage, and a control terminal, the control circuit comprising:

an amplifier circuit coupled in a feedback loop between the second terminal and the control terminal to produce a control voltage on a control line that is coupled to the control terminal of the pass transistor;

a switch that includes a transistor configured to transition between a first switch state in which the switch opens the feedback loop and a second switch state in which the switch closes the feedback loop;

a switch control circuit that includes a delay circuit, wherein the delay circuit is coupled to the input voltage and is configured to maintain the switch in the first switch state during a first time interval and to transition the switch to the second switch state after the first time interval.

* * * * *